US010894655B2

(12) United States Patent
Tan

(10) Patent No.: US 10,894,655 B2
(45) Date of Patent: Jan. 19, 2021

(54) COMBINATION FOOD PAD CONTAINER AND DISPENSER

(71) Applicant: Stephanie Tan, Harahan, LA (US)

(72) Inventor: Stephanie Tan, Harahan, LA (US)

( * ) Notice: Subject to any disclaimer, the term of this patent is extended or adjusted under 35 U.S.C. 154(b) by 0 days.

(21) Appl. No.: 16/240,548

(22) Filed: Jan. 4, 2019

(65) Prior Publication Data

US 2019/0135527 A1 May 9, 2019

Related U.S. Application Data

(63) Continuation of application No. 14/931,870, filed on Nov. 4, 2015, now Pat. No. 10,207,858, which is a continuation-in-part of application No. 14/588,237, filed on Dec. 31, 2014, now Pat. No. 10,144,575, which is a continuation of application No. PCT/US2013/057050, filed on Aug. 28, 2013.

(51) Int. Cl.

| | |
|---|---|
| ***B65D 83/08*** | (2006.01) |
| ***B65D 75/58*** | (2006.01) |
| ***B65D 75/56*** | (2006.01) |
| *B65B 67/00* | (2006.01) |

(52) U.S. Cl.

CPC ..... *B65D 83/0805* (2013.01); *B65D 75/566* (2013.01); *B65D 75/5827* (2013.01); *B65B 67/00* (2013.01)

(58) Field of Classification Search

CPC ..... A47K 10/20; A47K 10/426; A47K 2010/3233; A47K 2201/02; B65D 81/264; B65D 83/0805

See application file for complete search history.

(56) References Cited

U.S. PATENT DOCUMENTS 2,023,542 A * 12/1935 Peck ..... B65D 5/16 206/449
2,098,477 A * 11/1937 Welsh ..... B65D 83/0805 221/45
2,145,181 A * 1/1939 Kennedy ..... B65D 83/02 229/242

(Continued)

FOREIGN PATENT DOCUMENTS

JP 2000296889 A 10/2000

*Primary Examiner* — Gene O Crawford
*Assistant Examiner* — Kelvin L Randall, Jr.
(74) *Attorney, Agent, or Firm* — David A. Belasco; Belasco Jacobs & Townsley, LLP

(57) ABSTRACT

A combination food pad container and dispenser can be constructed from the following components. A sealed elongated container is provided. The container is formed of flexible film material and has at least one surrounding wall, a closed top and a closed bottom and at least one mounting aperture. The aperture is located adjacent the top. The container is sized and shaped to slidably surround a plurality of horizontally stacked food pads. The pads have at least one planar surface. The surrounding wall has at least one openable perforation. The perforation is orthogonal to the planar surface. The perforation has at least one arresting feature. The arresting feature provides an intermediate point for controlling initial opening of the perforation. A single rigid member is provided within the dispenser with the food pads disposed opposite the at least one openable perforation. The rigid member maintains the dispenser in a free-standing vertical orientation.

5 Claims, 12 Drawing Sheets

(56) References Cited

U.S. PATENT DOCUMENTS 2,678,768 A * 5/1954 Vergobbi ..... B65D 33/02 383/106
2,784,929 A 3/1957 Diening
3,002,651 A * 10/1961 Gauld ..... B65D 5/726 206/499
3,071,244 A * 1/1963 Doran ..... B65D 5/5495 206/273
3,083,866 A 4/1963 Strange
3,124,298 A * 3/1964 Repko ..... B65D 75/5844 206/449
3,127,274 A * 3/1964 Weinke ..... B65D 75/54 229/87.11
3,127,991 A * 4/1964 Burnett ..... B65D 5/542 206/499
3,243,078 A * 3/1966 Pherson ..... A47K 10/423 221/48
3,281,056 A 10/1966 Kugler
3,306,492 A 2/1967 Kugler
3,918,589 A * 11/1975 Nausedas ..... A47F 13/085 211/57.1
4,216,863 A 8/1980 Seymour-Smith
4,365,709 A * 12/1982 Lester ..... B65D 5/16 206/362
4,535,912 A 8/1985 Bonk
4,537,330 A 8/1985 Gelbard
4,611,719 A 9/1986 Dudek
RE32,443 E * 6/1987 Kalal ..... B65D 75/54 206/348
4,852,739 A * 8/1989 Franco ..... B65D 81/051 206/387.1
4,993,589 A 2/1991 McLaughlin
5,100,000 A 3/1992 Huseman
5,386,910 A 2/1995 Liss
5,647,506 A 7/1997 Julius
5,655,682 A * 8/1997 Hoffrichter ..... B65D 33/001 206/554
5,762,260 A * 6/1998 Goglio ..... B65D 33/007 229/199
5,857,586 A 1/1999 Scherr
5,862,944 A 1/1999 Scherr
5,927,660 A 7/1999 Mcnerney
5,941,392 A 8/1999 Huang
5,954,432 A * 9/1999 Laudenberg ..... B65D 33/08 383/10
5,988,367 A 11/1999 Gemma, Jr.
6,021,919 A 2/2000 Kelly
6,209,724 B1 * 4/2001 Miller ..... B65D 5/72 206/449
6,328,158 B1 * 12/2001 Bisbal ..... A45C 3/00 206/223
6,334,710 B1 * 1/2002 Kuge ..... B65D 31/08 383/104
6,443,327 B1 9/2002 Chen
6,557,811 B1 5/2003 Burns
6,578,729 B2 * 6/2003 Grinberg ..... A41D 19/0072 2/159
6,588,626 B2 * 7/2003 Sauer ..... A47K 10/42 206/494
6,769,565 B2 * 8/2004 Tramontina ..... A47K 10/424 221/197
7,000,802 B2 2/2006 Kringel
7,090,096 B2 8/2006 Simpson
7,452,132 B2 * 11/2008 Tang ..... B65D 33/2508 383/100
7,815,097 B2 * 10/2010 Fogle ..... B65D 5/4608 206/141
7,887,473 B2 * 2/2011 Nagata ..... B65D 33/02 493/210
7,934,597 B2 * 5/2011 Zwick ..... B65D 83/0894 206/233
7,975,455 B1 7/2011 Abrahamsen
8,567,618 B2 10/2013 Tan
8,985,338 B2 * 3/2015 Fux ..... B65B 63/02 206/756
9,284,109 B2 * 3/2016 James ..... B65D 83/00
2002/0084204 A1 * 7/2002 Dilnik ..... A45C 11/008 206/494
2002/0139811 A1 * 10/2002 Tramontina ..... A47K 10/424 221/197
2004/0099677 A1 * 5/2004 Harris ..... A41D 13/11 221/33
2004/0124207 A1 * 7/2004 Tramontina ..... A47K 10/424 221/305
2004/0154949 A1 * 8/2004 Lenhard ..... A47K 13/165 206/494
2006/0021894 A1 2/2006 Clark, Jr.
2006/0283996 A1 * 12/2006 Jensen ..... A47L 13/16 241/195
2007/0215630 A1 9/2007 Tramontina
2010/0000894 A1 1/2010 Noda
2010/0072334 A1 3/2010 Le Gette
2010/0282637 A1 * 11/2010 Clark, Jr. ..... B65D 75/46 206/581
2010/0310198 A1 * 12/2010 Port ..... B65D 75/12 383/203
2011/0062179 A1 * 3/2011 Stollery ..... B65D 83/0876 221/45
2013/0200093 A1 * 8/2013 Carlson ..... B65D 75/56 221/1
2013/0341117 A1 * 12/2013 Fishberger ..... A61B 7/02 181/131
2015/0196176 A1 * 7/2015 Felix ..... A47K 10/3618 221/46
2015/0203272 A1 * 7/2015 Versteylen ..... B65D 81/264 53/400

* cited by examiner

COMBINATION FOOD PAD CONTAINER AND DISPENSER

RELATED APPLICATIONS

The instant application is a continuation of U.S. application Ser. No. 14/931,870, filed Nov. 4, 2015 and currently pending, which is a continuation-in-part of U.S. application Ser. No. 14/588,237, filed Dec. 31, 2014 and currently pending, which is a continuation of PCT Application Serial No. PCT/US2013/057050, filed Aug. 28, 2013 and currently expired. The instant application incorporates all of the above by reference in their entirety.

FIELD OF INVENTION

The invention pertains to absorbent food pads used for packaging meat and other liquid containing items. More particularly, the invention relates to a dispenser for dispensing food pads and a rack for supporting the dispenser. The invention also includes special partially openable covers for the dispensing slot of the container.

BACKGROUND OF THE INVENTION

When meat, poultry or even fish is packaged for display in modern markets, the food has a tendency to produce fluids that will accumulate in the package. These fluids may leak from the package and create health and sanitation risks. To solve this problem, absorbent food pads have been developed. These pads are typically made of plastic and fiber composites and are placed under the food item which is placed in a paper or plastic container claims prior to being covered with a transparent film product. In this way, any fluids produced by the food will be absorbed and the resulting package will be dry and clean.

When the food pads are used in packaging meat, poultry or fish it is critical that the pads be kept in a sanitary condition prior to use. The present invention provides a sanitary environment for the storage and dispensing of food pads to restrict any possibility of contamination of the pads prior to use. Special partially openable covers for the dispensing opening of the container further insure cleanliness of the food pads prior to use. At the same time, the dispensing of the food pads is made efficient through the use of a rigid element that supports the dispenser.

A variety of inventions have been developed for dispensing plastic bags and related items from vertically oriented dispensers or other containers.

U.S. Pat. No. 6,209,724, issued to Miller is directed a package and a dispenser for glass fiber filter pads. The bag serves as a dispenser for a stack of fiberglass pads and includes a portion which may be cut, in two different embodiments, or to form an aperture through which the filter pads may be removed one at a time while retaining the remainder therein. The pads to be dispensed are arranged in a stack of substantially planar parallel pads and are enclosed within a fluid-impervious envelope providing a fluid tight seal until dispensing is desired. The pads are formed into a stack and are arranged in side-by-side relationship and contained within a polymer film bag. The preferred embodiment for the dispenser includes a cardboard panel with intersecting lines which may be cut to form intersecting slits through which the pads may be removed, one at a time as needed. The panel is shown with a preferred material, namely cardboard, however, it could of course be made with paper board, plastic or other suitable material.

U.S. Pat. No. 4,216,863, issued to Seymour-Smith, disclose a bag pack which contains a plurality of plastic film bags or other materials. The bags are arranged individually within the bag and a removable panel is provided in order that the bags may be removed one at a time as needed. The wallet or holder is formed from a sheet of polyethylene film which includes a removable panel in order to give access to the individual bags within the stack as needed. The wallet or holder also includes a punched hole by which the entire wallet or container may be suspended vertically from a hook.

U.S. Pat. Nos. 5,862,944 and 5,857,586 issued to Scherr are directed a dispenser for plastic bags which is formed into a flexible plastic bag pouch with a removable flap allowing individual bags held within to be removed one at a time as needed. The dispenser is formed of a flexible thermoplastic front panel or sheet with a removable flap in order to gain access and allow for individual bags held within to be removed from the pouch. The pouch also includes a hole through which a hook may pass to serve as a rack for the dispenser. The '586 Patent is substantially the same structure but the dispenser is mounted on a rack using a Velcro attachment system.

U.S. Pat. No. 3,306,492, issued to Kugler is directed to a flexible plastic bag dispenser. The dispenser serves as a holder for a stack of plastic bags which may then be dispensed one at a time as needed. The dispensing bag is of a general overhaul flat configuration and may be pinned or held by a hook passing through openings and a header. The front wall of the bag dispenser has an access opening through which individual bags may be removed as needed.

U.S. Pat. No. 4,537,330, issued to Gelbard is directed to a bag dispensing system from which individual bags may be dispensed as needed from perforated pull-out panel which is made possible by perforations. A U-shaped bracket or hanger is provided in order to support the stack of plastic bags and is shaped into a receiving point with a catch which may be used to support the entire assembly onto a rack.

While other variations exist, the above-described designs for dispenser bags and pouches are typical of those encountered in the prior art. It is an objective of the present invention to provide a sanitary and convenient dispenser for food pads. It is another objective to provide a partially openable cover for the dispensing opening of the container. It is a further objective to provide a dispenser that is simple and economical to manufacture. It is yet a further objective to provide a dispenser that may be easily shipped and stored. It is a still further objective of the invention to provide a rigid element within the dispenser to allow it to be free-standing. Finally, it is an objective of the invention to provide means to attach the dispenser to a wall or other surface for ease of use.

While some of the objectives of the present invention are disclosed in the prior art, none of the inventions found include all of the requirements identified.

SUMMARY OF THE INVENTION

The present invention addresses all of the deficiencies of prior art food pad dispenser and rack inventions and satisfies all of the objectives described above.

(1) A combination food pad container and dispenser can be constructed from the following components. A sealed elongated container is provided. The container is formed of flexible or resilient film material and has at least one surrounding wall, a closed top and a closed bottom and at least one mounting aperture. The aperture is located adjacent the top. The container is sized and shaped to slidably surround a plurality of horizontally stacked food pads. The pads have at least one planar surface. The surrounding wall has at least one openable perforation. The perforation is orthogonal to the planar surface. The perforation has at least one arresting feature. The arresting feature provides an intermediate point for controlling initial opening of the perforation. A rack for supporting the container is provided. The rack has at least one protrusion. The protrusion is sized and shaped to fit slidably through the at least one aperture.

(2) In a variant of the invention the at least one surrounding wall includes a front wall, a rear wall, first and second side walls, all of the walls are attached to the closed top and the closed bottom.

(3) In another variant, the at least one mounting aperture is located in an extension of the rear wall.

(4) In still another variant, the at least one mounting aperture is located in a two layer segment formed as an extension of the rear wall and the top.

(5) In yet another variant, the rack further comprises an angled platform. The platform supports the container when suspended from the at least one protrusion. The angled platform is rotatably mounted to a back support. The back support is rotatably mounted to a base.

(6) In a further variant, the base includes at least one stop. The stop controls an angular position of the angled platform.

(7) In still a further variant, the base includes a stabilizing bar. The bar is orthogonally mounted to the base.

(8) In yet a further variant, the angled platform and the back support fold flat to become coplanar with the base for transport and storage.

(9) In another variant of the invention, the arresting feature is an orthogonal cut through the flexible or resilient film material of the container across the perforation at a point located between an upper end and a lower end of the perforation.

(10) In still another variant, a supporting panel is provided. The panel is located within the container between the stacked food pads and the perforation. The panel has a central slot. The slot extends on either side of the perforation along at least a portion of a length of the perforation.

(11) In yet another variant, a combination food pad container and dispenser includes a sealed elongated container. The container is sized and shaped to slidably surround a plurality of horizontally stacked food pads. The pads have at least one planar surface. The container is formed of flexible film material and has at least one surrounding wall, a closed top and a closed bottom. The surrounding wall has at least one openable perforation. The perforation is orthogonal to the planar surface. The perforation has at least one arresting feature. The arresting feature provides an intermediate point for controlling initial opening of the perforation. A rigid member is provided. The member supports the dispenser in a free-standing vertical orientation.

(12) In a further variant, at least one mounting aperture is provided. The aperture is located adjacent the top.

(13) In still a further variant, the dispenser further includes hooking and looping elements for mounting to a surface.

(14) In yet a further variant, the dispenser is mounted to a surface using an element selected from the group that includes hooks, posts, mounting spikes, prongs, chords and ties.

(15) In another variant of the invention, a wall mounting bracket is provided. The bracket has attachment features for attaching to a wall and at least one protrusion. The protrusion is sized and shaped to fit slidably within the at least one mounting aperture.

(16) In still another variant, the arresting feature is an orthogonal cut through the flexible or resilient film material of the container across the perforation at a point disposed between an upper end and a lower end of the perforation.

(17) In yet another variant, a supporting panel is provided. The panel is located within the container between the stacked food pads and the perforation. The panel has a central slot. The slot extends on either side of the perforation along at least a portion of a length of the perforation.

(18) In a further variation, an open-topped tray formed of resilient material is provided. The tray has an interior width at least equal to a food pad. A mating cover is provided. The cover is sized and shaped to fit slidably over the tray. A dispensing slot is provided. The slot is centrally disposed in the cover.

(19) In still a further variant, a sanitary shield is provided. The shield is formed of flexible film material. The shield covers the dispensing slot and has at least one perforation located over the slot.

(20) In yet a further variant, an arresting feature is provided. The arresting feature provides an intermediate point for controlling initial opening of the perforation.

(21) In another variant of the invention, the arresting feature is an orthogonal cut through the flexible film material of the shield across the perforation at a point located between an upper end and a lower end of the perforation.

(22) In a final variant of the invention, the at least one perforation is perpendicular to side edges of the slot, thereby permitting partial removal of the sanitary shield and partial opening of the dispensing slot.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

Figure 1:
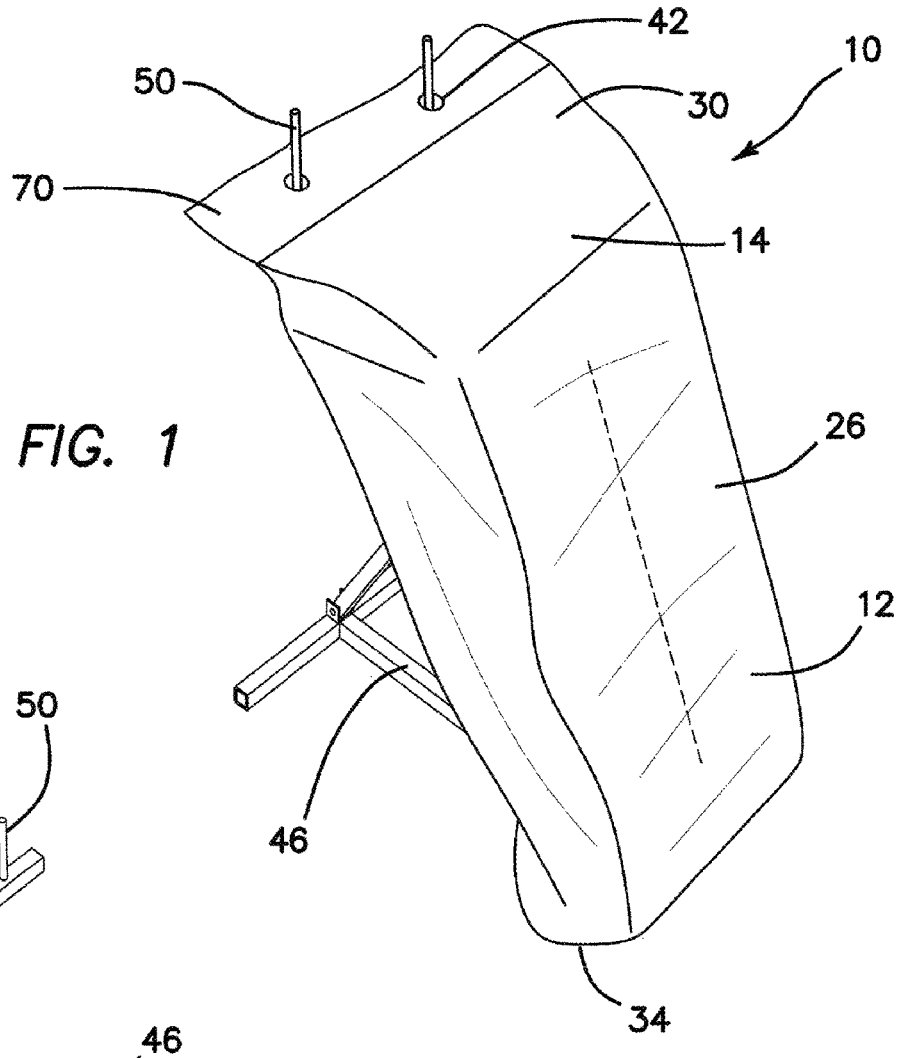
FIG. 1 is a perspective view of a preferred embodiment of a food pad dispenser and rack.

The present invention addresses all of the deficiencies of prior art food pad dispenser and rack inventions and satisfies all of the objectives described above.

(1) FIGS. 1-10 illustrate a combination food pad container and dispenser 10 that can be constructed from the following components. As illustrated in FIGS. 1, 1A, 3-5 and 9-10, a sealed elongated container 14 is provided. The container 14 is formed of flexible or resilient film material 12 and has at least one surrounding wall 26, a closed top 30 and a closed bottom 34 and at least one mounting aperture 42. The aperture 42 is located adjacent the top 30. The container 14 is sized and shaped to slidably surround a plurality of horizontally stacked food pads 18. The pads 18 have at least one planar surface 22. The surrounding wall 26 has at least one openable perforation 38. The perforation 38 is orthogonal to the planar surface 22. The perforation 38 has at least one arresting feature 40. The arresting feature 40 provides an intermediate point 44 for controlling initial opening of the perforation 38. A rack 46 for supporting the container 10 is provided. The rack 46 has at least one protrusion 50. The protrusion 50 is sized and shaped to fit slidably through the at least one aperture 42.

(2) In a variant of the invention, as illustrated in FIGS. 1, 3-5 and 7-10, the at least one surrounding wall 26 includes a front wall 54, a rear wall 58, first 62 and second 66 side walls, all of the walls 54, 58, 62 and 66 are attached to the closed top 30 and the closed bottom 34.

Figure 10:
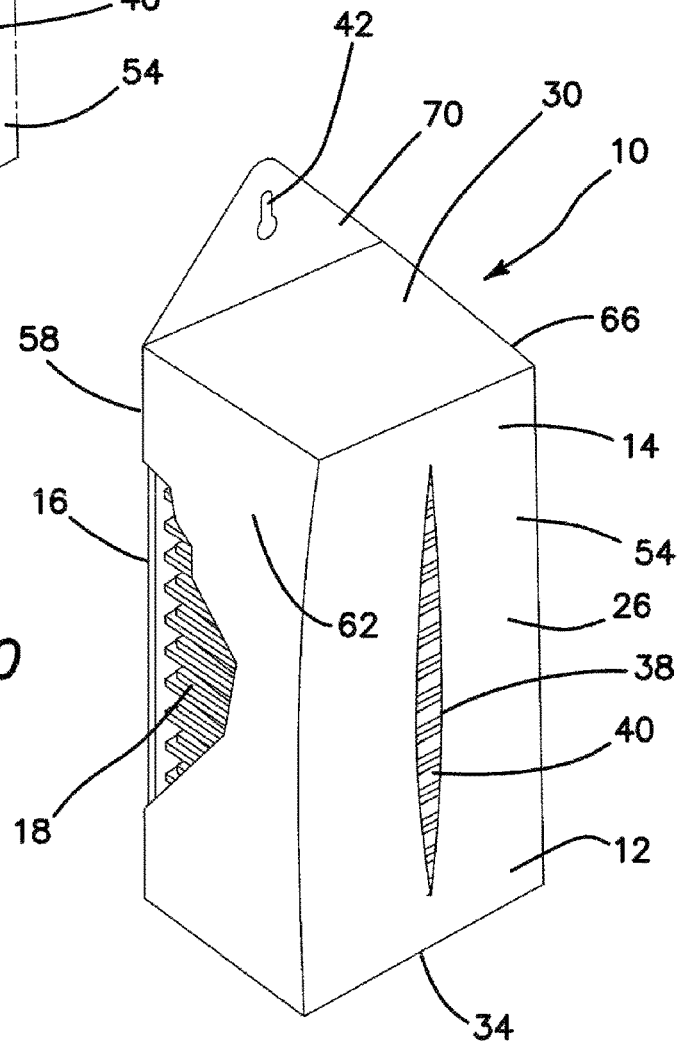
FIG. 10 is a perspective view of the FIG. 9 embodiment illustrating a perforated opening in the front wall and an aperture at the top end for supporting the dispenser on a hook or other protrusion.

(3) In another variant, as illustrated in FIGS. 1 and 10, the at least one mounting aperture 42 is located in an extension 70 of the rear wall 58.

Figure 3:
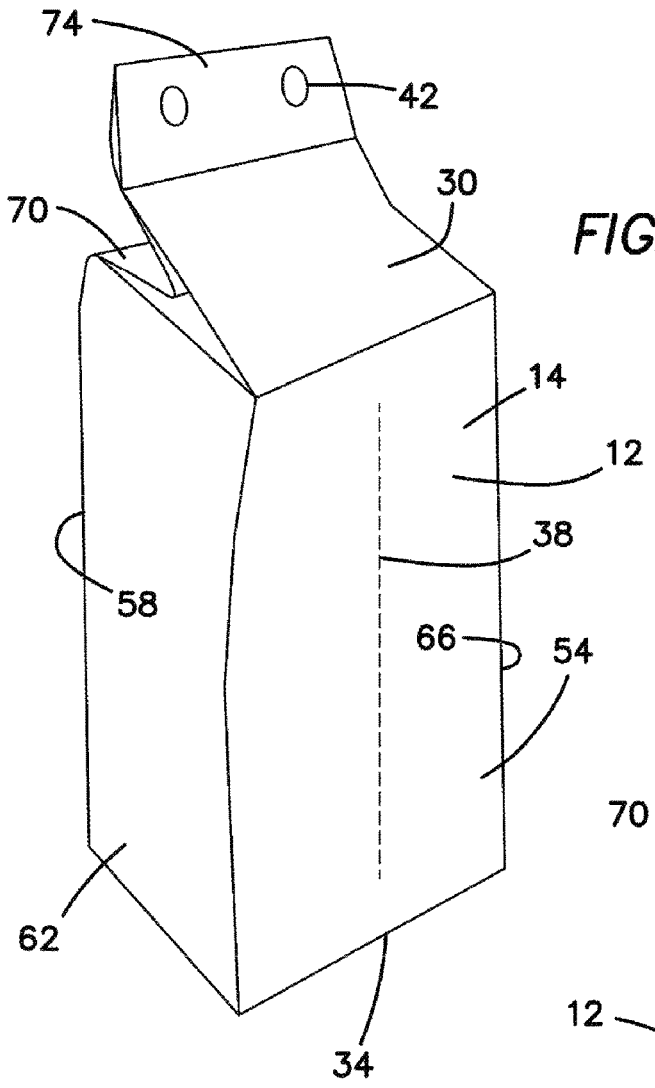
FIG. 3 is a perspective view of the dispenser of the FIG. 1 embodiment.
Figure 4:
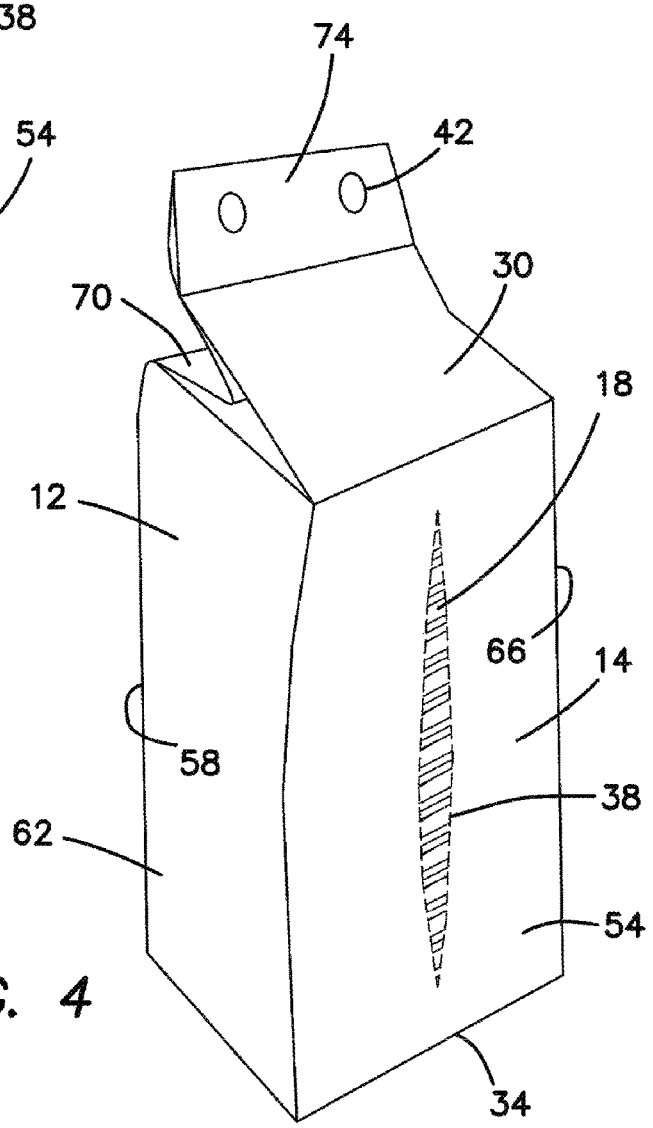
FIG. 4 is a perspective view of the FIG. 3 dispenser illustrating a front side perforation and enclosed food pads.
Figure 5:
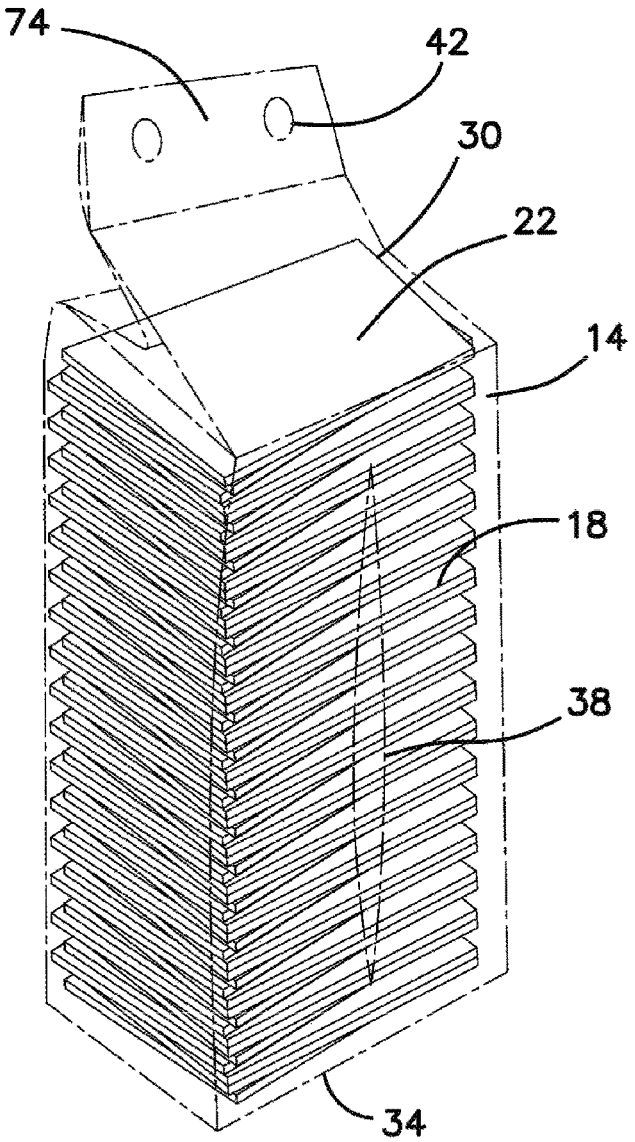
FIG. 5 is a perspective view of the FIG. 3 dispenser illustrating the enclosed stack of food pads.
Figure 6:
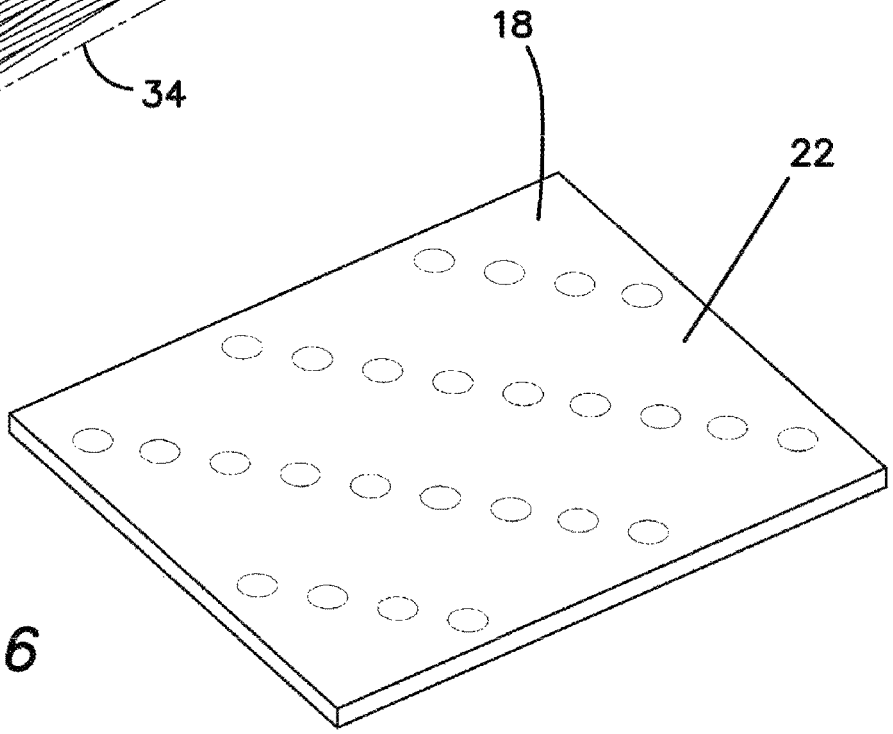
FIG. 6 is an enlarged perspective view of a food pad.

(4) In still another variant, as illustrated in FIGS. 3-5, the at least one mounting aperture 42 is located in a two layer segment 74 formed as an extension of the rear wall 58 and the top 30.

Figure 2:
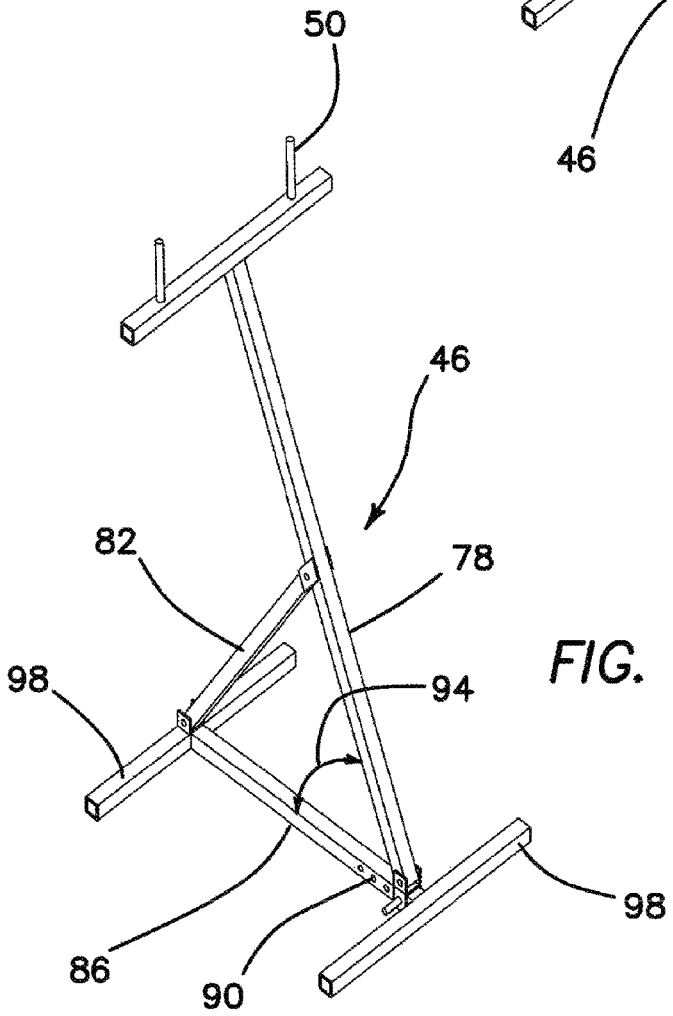
FIG. 2 is a perspective view of the rack of the FIG. 1 embodiment.

(5) In yet another variant, as illustrated in FIGS. 1 and 2, the rack 46 further comprises an angled platform 78. The platform 78 supports the container 10 when suspended from the at least one protrusion 50. The angled platform 78 is rotatably mounted to a back support 82. The back support 82 is rotatably mounted to a base 86.

(6) In a further variant, the base 86 includes at least one stop 90. The stop 90 controls an angular position 94 of the angled platform 78.

(7) In still a further variant, the base 86 includes a stabilizing bar 98. The bar 98 is orthogonally mounted to the base 86.

(8) In yet a further variant, the angled platform 78 and the back support 82 fold flat to become coplanar with the base 86 for transport and storage.

Figure 1A:
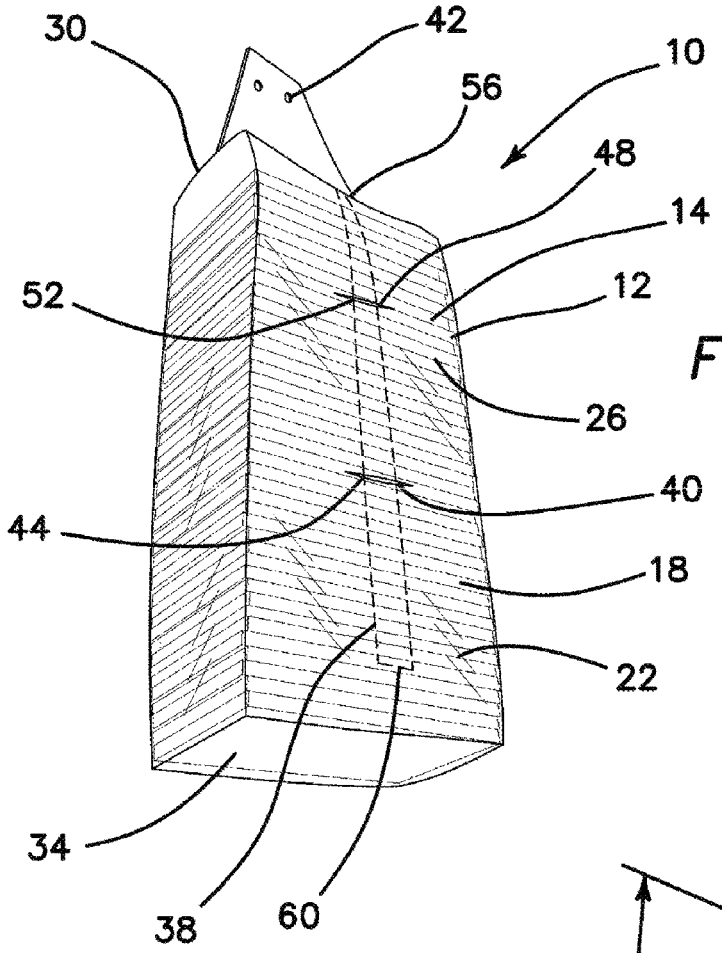
FIG. 1A is a perspective view of the FIG. 1 embodiment illustrating arresting features located across the perforation.
Figure 1B:
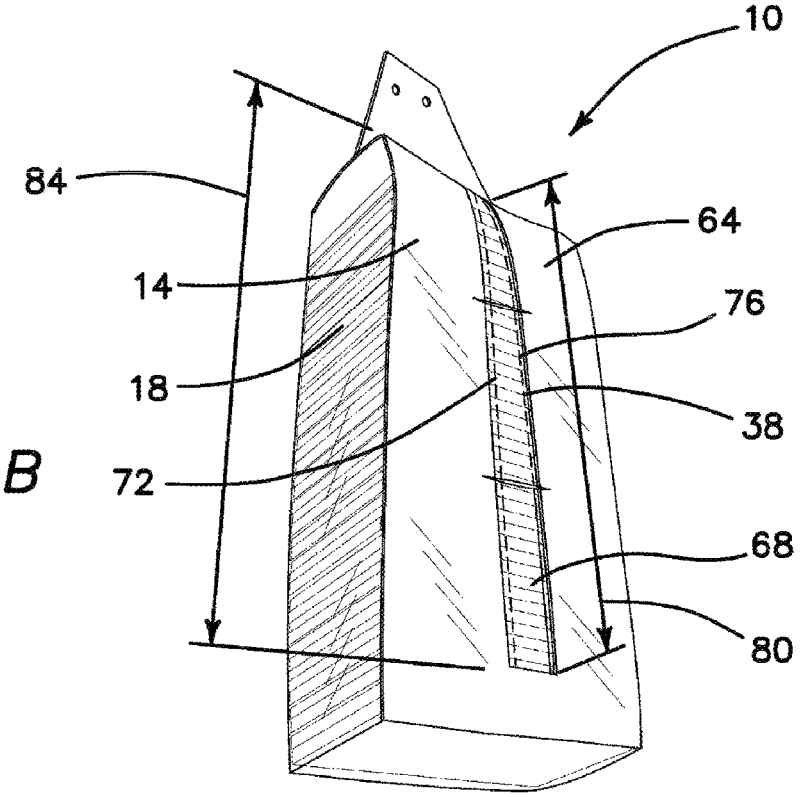
FIG. 1B is a perspective view of the FIG. 1 embodiment illustrating arresting features located across the perforation and a supporting panel between the food pads and the container.

(9) In another variant of the invention, as illustrated in FIGS. 1A and 1B, the arresting feature 40 is an orthogonal cut 48 through the flexible or resilient film material 12 of the container 14 across the perforation 38 at a point 52 located between an upper end 56 and a lower end 60 of the perforation 38.

(10) In still another variant, as illustrated in FIG. 1B, a supporting panel 64 is provided. The panel 64 is located within the container 14 between the stacked food pads 18 and the perforation 38. The panel 64 has a central slot 68. The slot 68 extends on either side 72, 76 of the perforation 38 along at least a portion 80 of a length 84 of the perforation 38.

(11) In another variant of the invention, as illustrated in FIGS. 9, 9A, 9B and 10, a combination food pad container and dispenser 10 includes a sealed elongated container 14. The container 14 is sized and shaped to slidably surround a plurality of horizontally stacked food pads 18. The pads 18 have at least one planar surface 22. The container 10 is formed of flexible film material 12 and has at least one surrounding wall 26, a closed top 30 and a closed bottom 34. The surrounding wall 26 has at least one openable perforation 38 or opening 40. The at least one perforation 38 beginning above the fifth stacked food pad 24 above the closed bottom 34 and terminating below the fifth stacked food pad 28 below the closed top 30. The perforation 38 is orthogonal to the planar surface 22. The perforation 38 has at least one arresting feature 40. The arresting feature 40 provides an intermediate point 44 for controlling initial opening of the perforation 38. A rigid member 16 is provided. The member 16 supports the dispenser 10 in a free-standing vertical orientation.

(12) In still another variant, as illustrated in FIGS. 1, 3-5 and 10, at least one mounting aperture 42 is provided. The aperture 42 is located adjacent the top 30.

Figure 7:
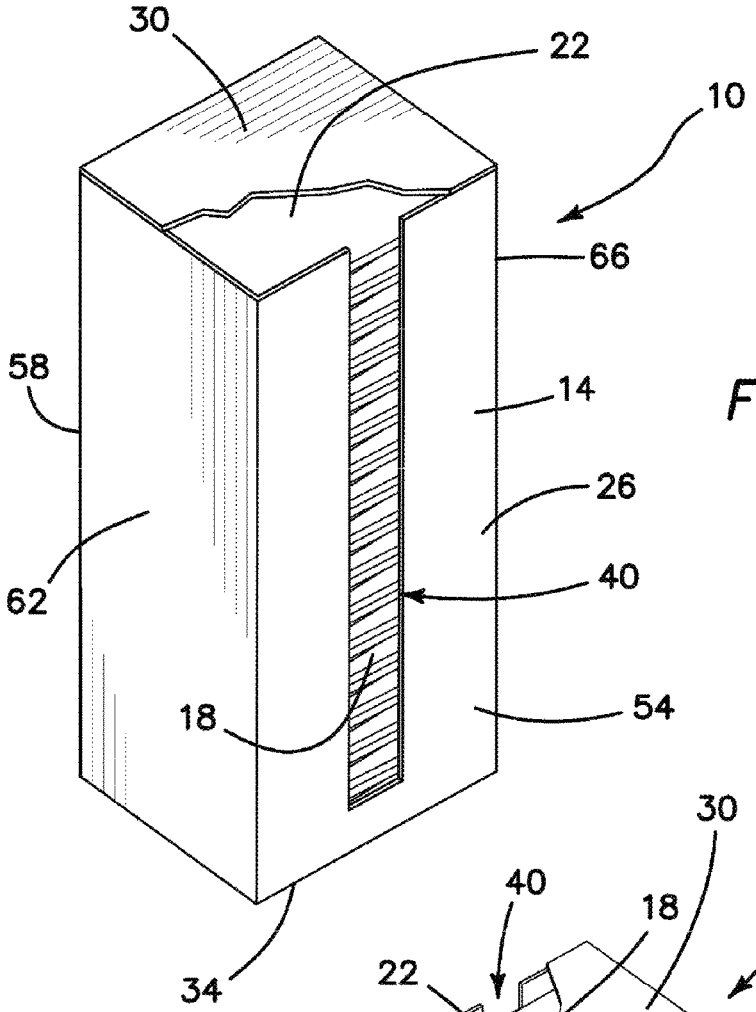
FIG. 7 is a perspective view of a rigid dispenser with an opening in the front wall.
Figure 8:
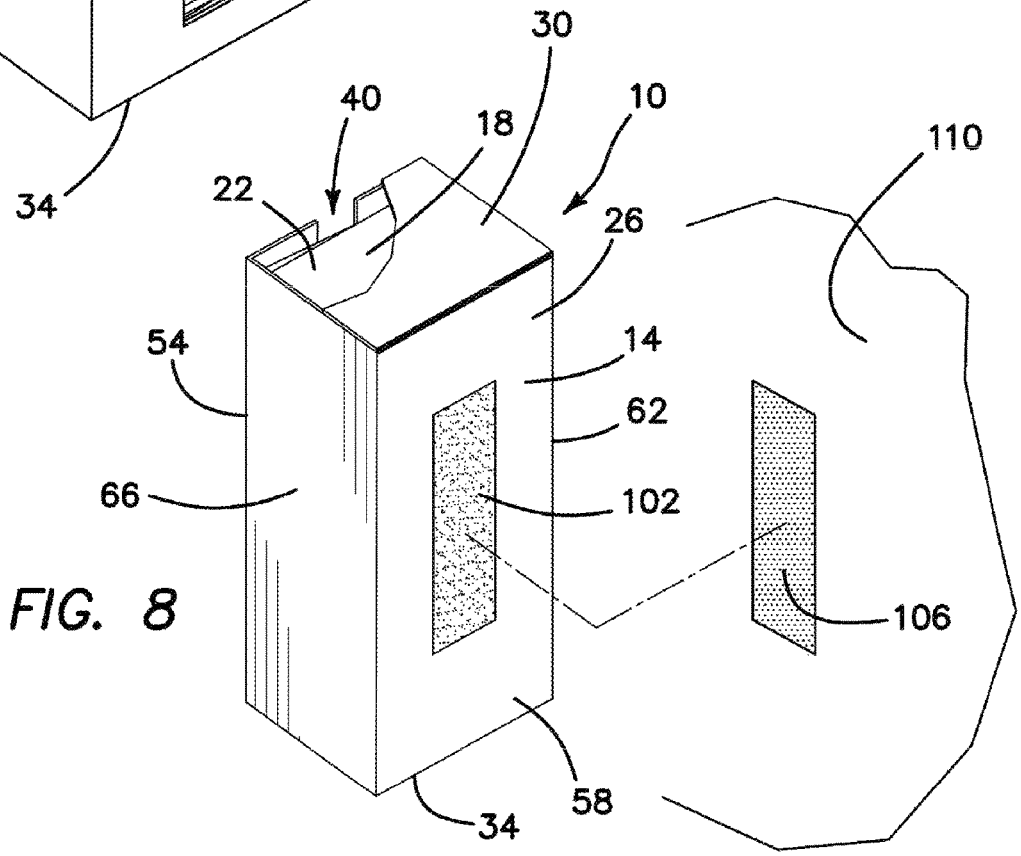
FIG. 8 is a rear perspective view of the FIG. 7 embodiment illustrating hooking and looping fasteners for attaching the dispenser to a surface.
Figure 9:
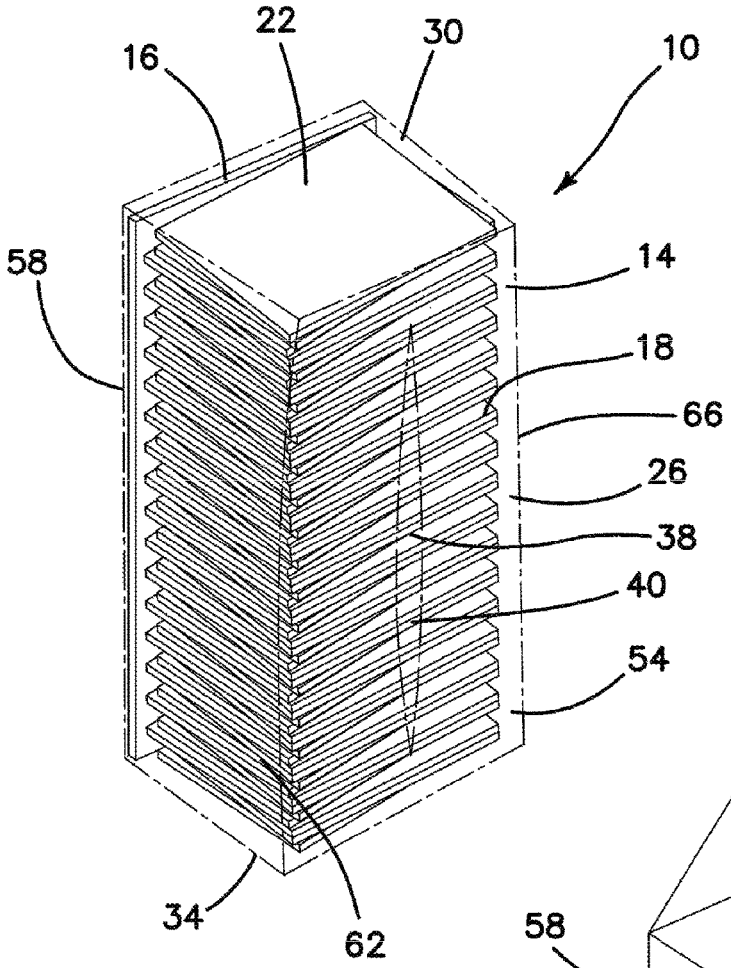
FIG. 9 is a perspective view of a dispenser formed of flexible material having a rigid member for providing support to the dispenser.

(13) In yet another variant, as illustrated in FIGS. 7 and 8, the dispenser 10 further includes hooking 102 and looping 106 elements for mounting to a surface 110.

Figure 11:
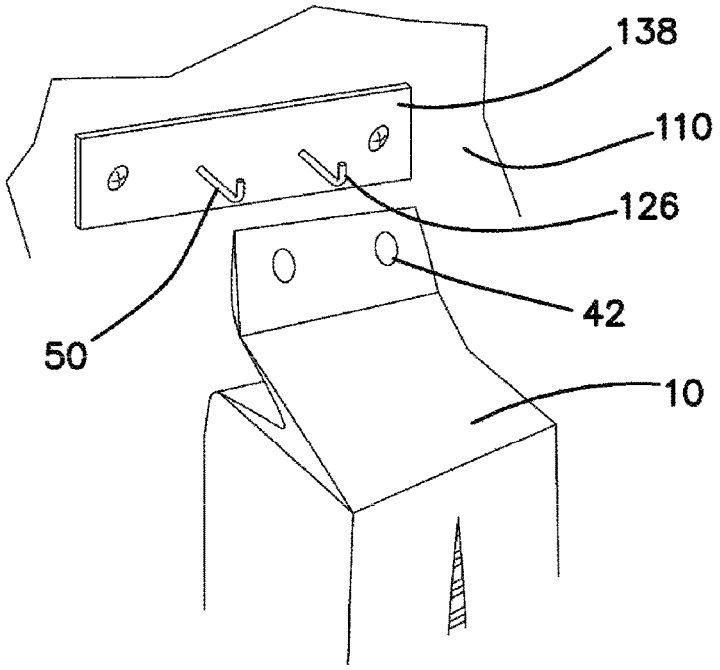
FIG. 11 is a perspective view of a wall mounted rack for the dispenser of the FIG. 1 embodiment.
Figure 12:
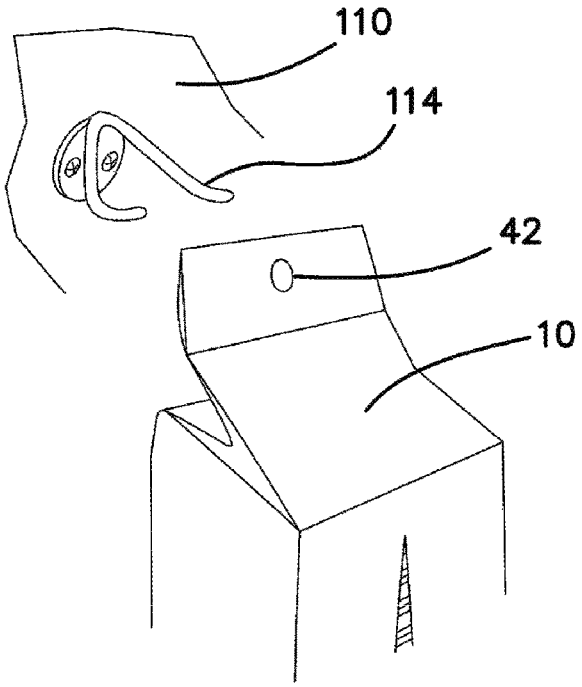
FIG. 12 is a perspective view of a wall mounted hook for use with a dispenser having a single mounting aperture.
Figure 13:
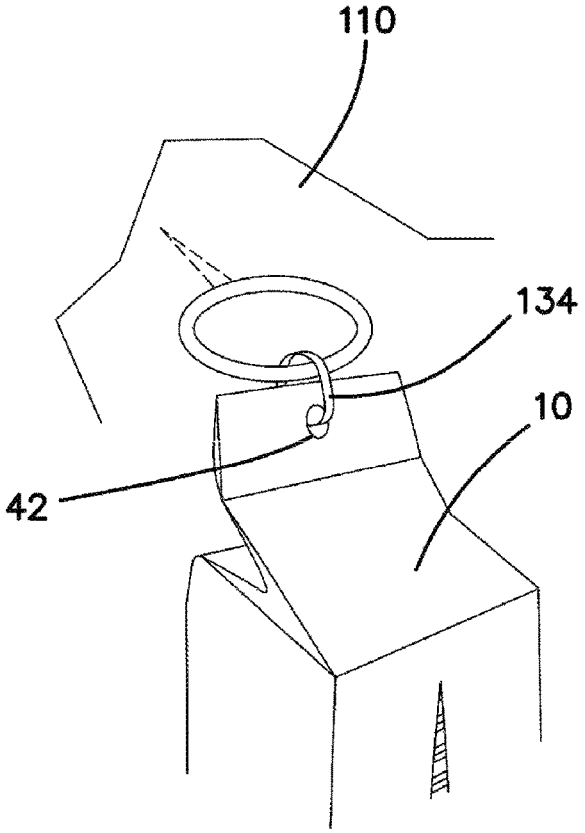
FIG. 13 is a perspective view of a wall mounted ring to which a dispenser can be attached with a tie or chord.
Figure 14:
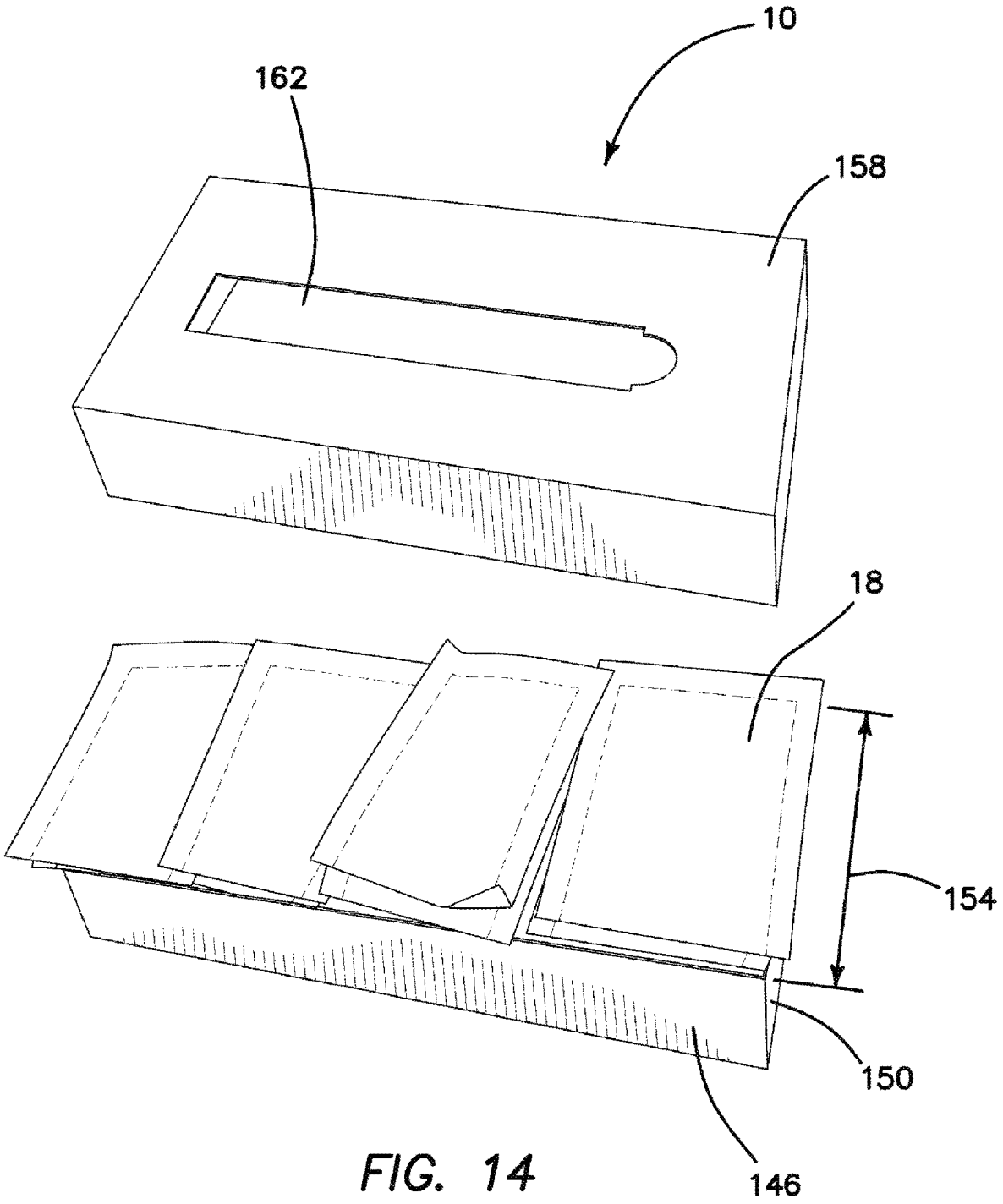
FIG. 14 is a perspective view of an alternative embodiment that includes a open topped tray and mating lid shown separated.
Figure 15:
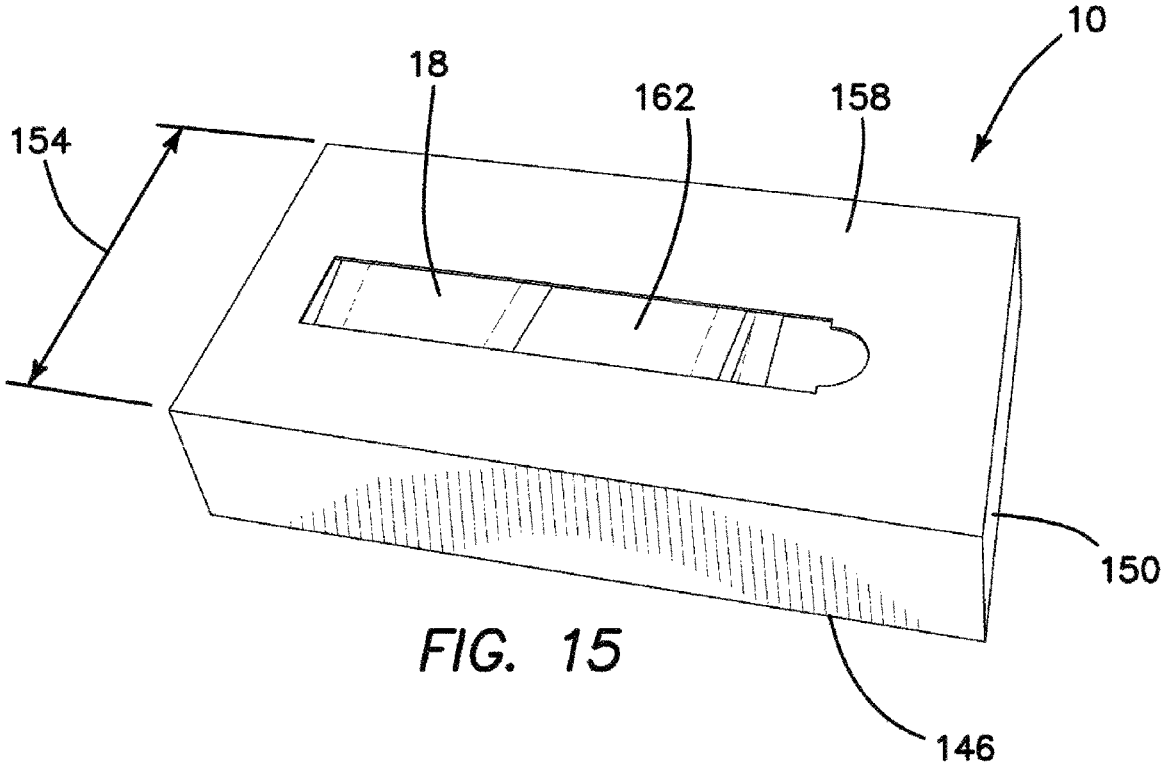
FIG. 15 is a perspective view of the FIG. 14 embodiment with the lid in place.

(14) In a further variant, as illustrated in FIGS. 11-13, the dispenser 10 is mounted to a surface 110 using an element selected from the group that includes hooks 114, posts 118, mounting spikes 122, prongs 126, chords 130 and ties 134.

(15) In another variation of the invention, a wall mounting bracket 138 is provided. The bracket 138 has attachment features for attaching to a wall 142 and at least one protrusion 50. The protrusion 50 is sized and shaped to fit slidably within the at least one mounting aperture 42.

Figure 9A:
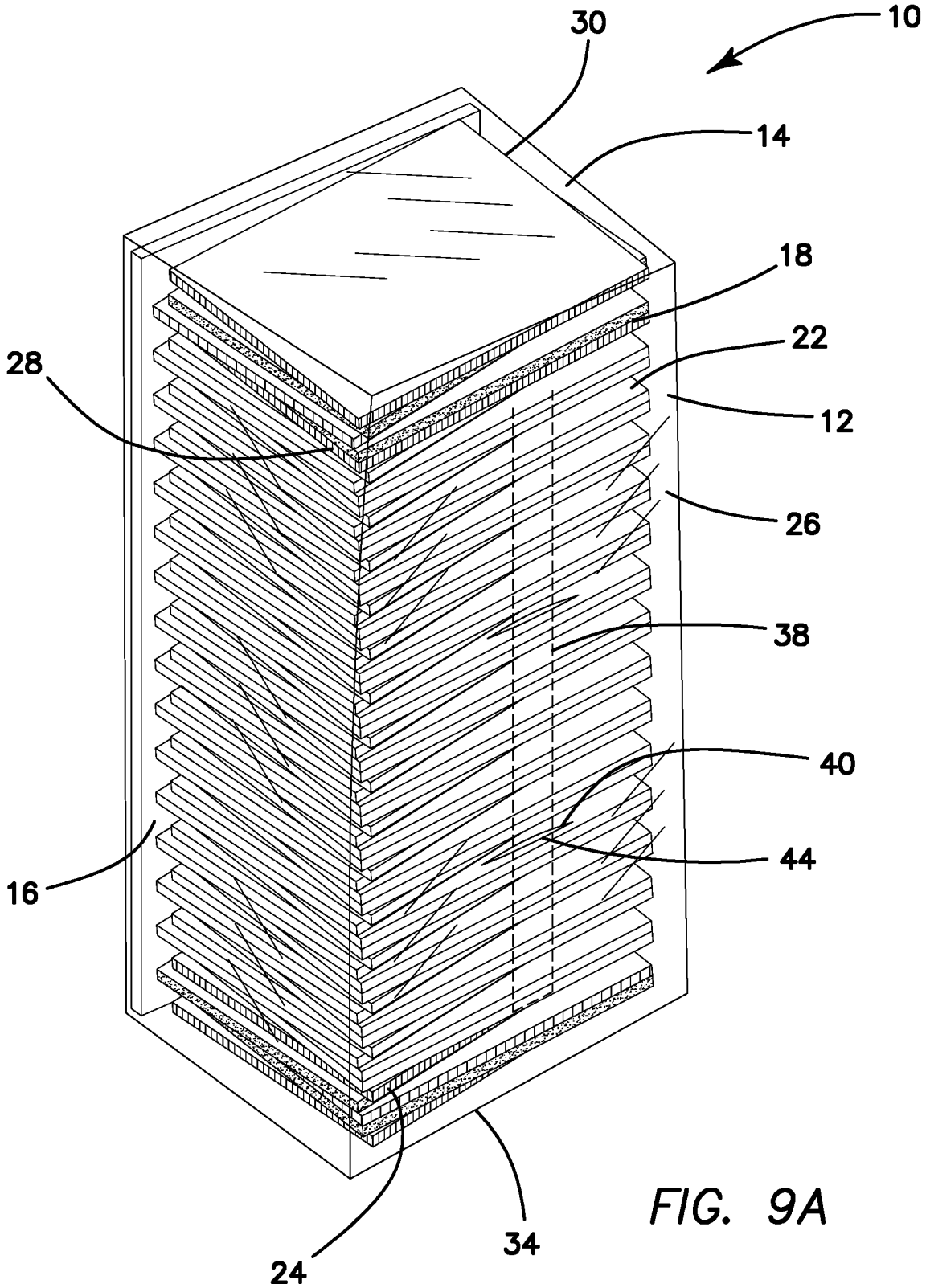
FIG. 9A is a perspective view of the FIG. 9 embodiment illustrating arresting features located across the perforation.
Figure 9B:
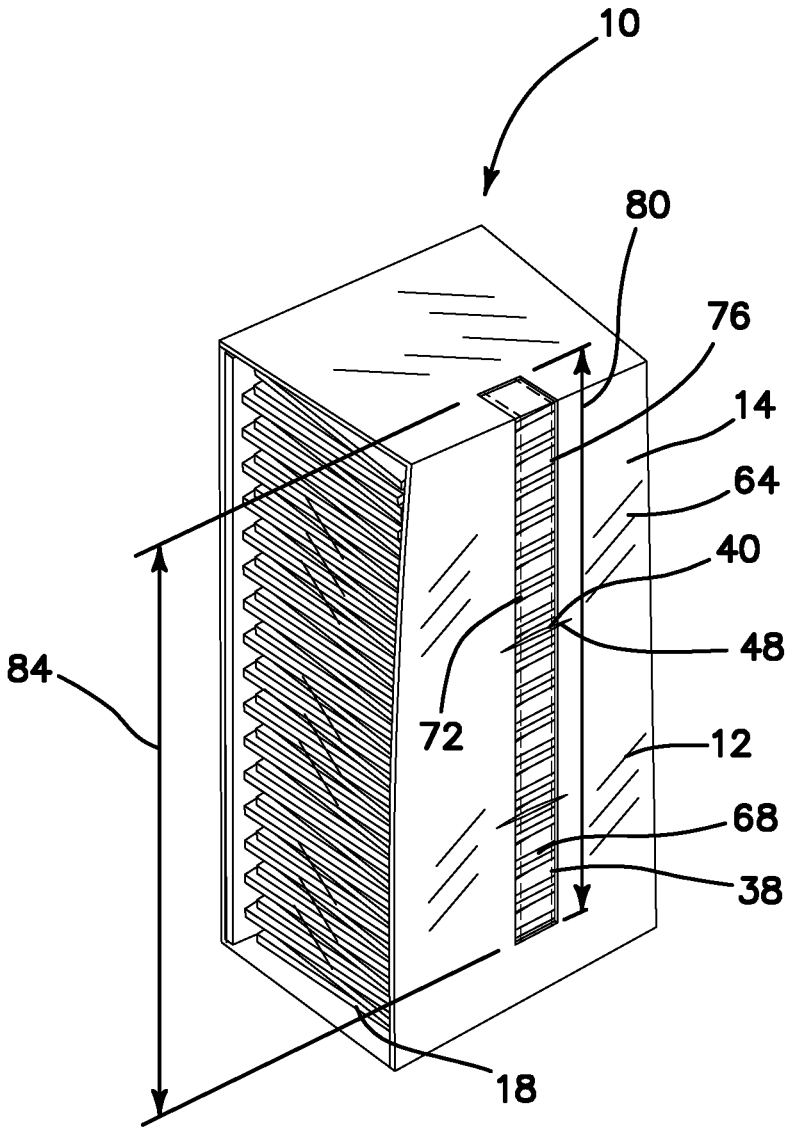
FIG. 9B is a perspective view of the FIG. 9 embodiment illustrating arresting features located across the perforation and a supporting panel between the food pads and the container.

(16) In still another variant, as illustrated in FIGS. 9A and 9B the arresting feature 40 is an orthogonal cut 48 through the flexible or resilient film material 12 of the container 14 across the perforation 38 at a point 52 located between an upper end 56 and a lower end 60 of the perforation 38. The panel 64 is located within the container 14 between the stacked food pads 18 and the perforation 38. The panel 64 has a central slot 68. The slot 68 extends on either side 72, 76 of the perforation 38 along at least a portion 80 of a length 84 of the perforation 38.

(18) In a further variation, as illustrated in FIGS. 14-17, an open-topped tray 146 formed of resilient material 150 is provided. The tray 146 has an interior width 154 at least equal to a width of a food pad 18. A mating cover 158 is provided. The cover 158 is sized and shaped to fit slidably over the tray 146. A dispensing slot 162 is provided. The slot 162 is centrally disposed in the cover 158.

Figure 16:
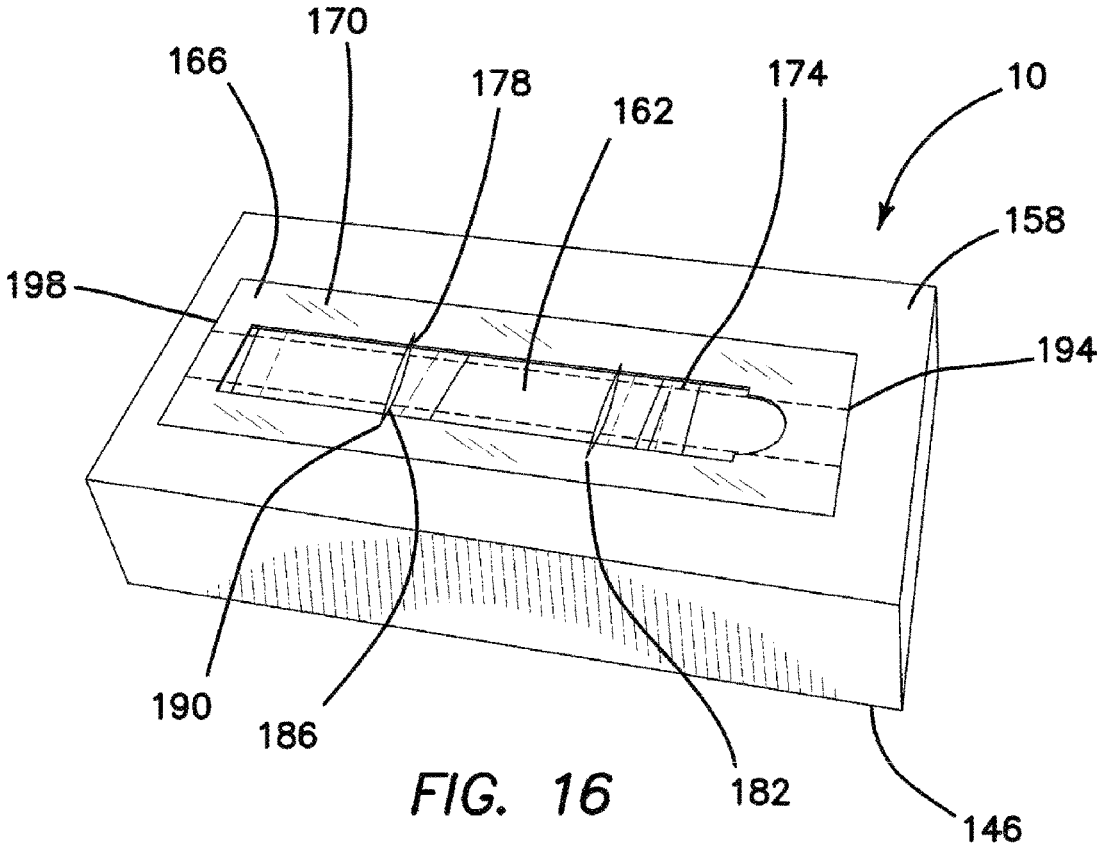
FIG. 16 is a perspective view of the FIG. 14 embodiment illustrating a sanitary shield with parallel perforations for the dispensing slot and orthogonal arresting features.
Figure 17:
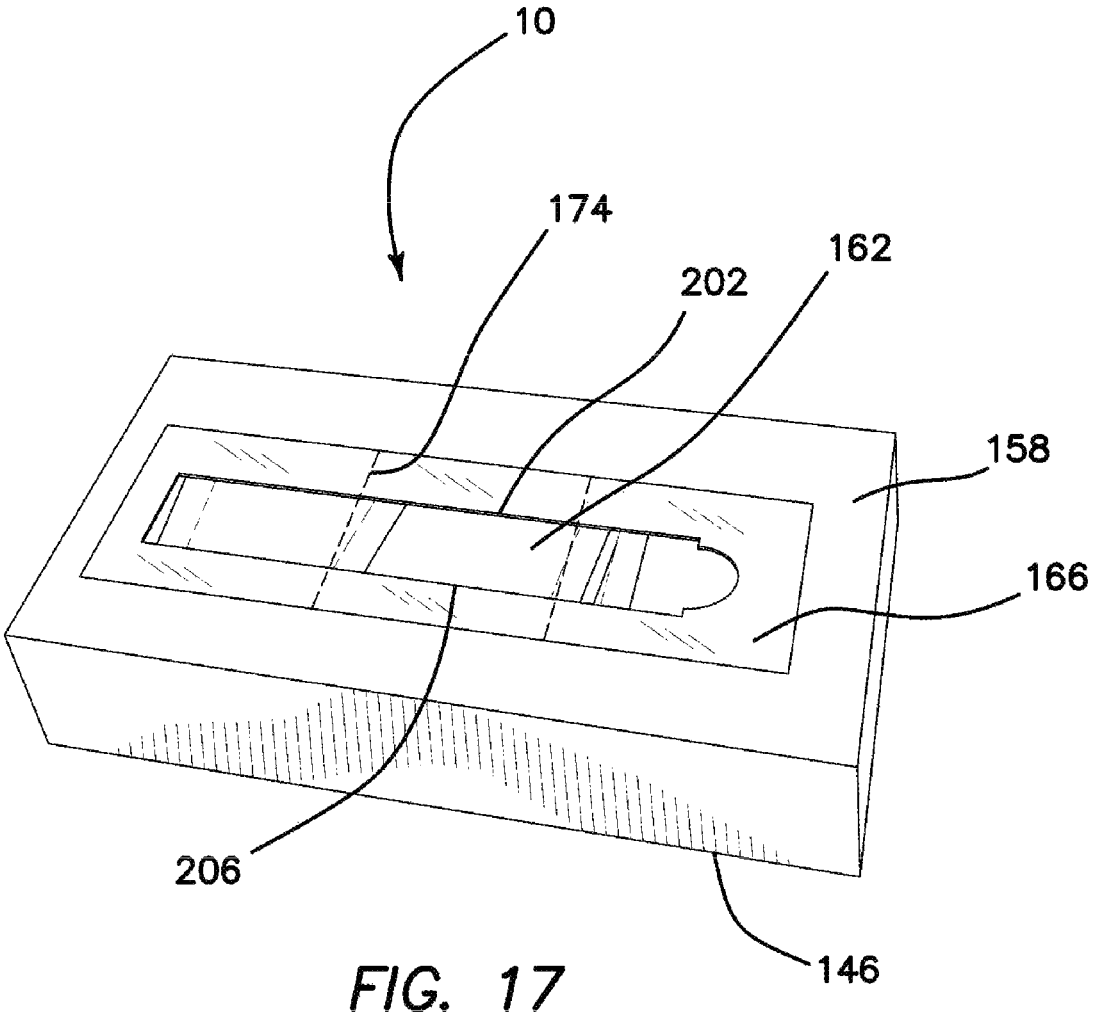
FIG. 17 is a perspective view of the FIG. 14 embodiment illustrating a sanitary shield with perpendicular perforations for the dispensing slot permitting partial removal of the shield.

(19) In still a further variant, as illustrated in FIGS. 16 and 17, a sanitary shield 166 is provided. The shield 166 is formed of flexible film material 170. The shield 166 covers the dispensing slot 162 and has at least one perforation 174 located over the slot 162.

(20) In yet a further variant, an arresting feature 178 is provided. The arresting feature 178 provides an intermediate point 182 for controlling initial opening of the perforation 174.

(21) In another variant of the invention, as illustrated in FIG. 16, the arresting feature 178 is an orthogonal cut 186 through the flexible film material 170 of the shield across the perforation 174 at a point 190 located between an upper end 194 and a lower end 198 of the perforation 174.

(22) In a final variant of the invention, as illustrated in FIG. 17, the at least one perforation 174 is perpendicular to side edges 202, 206 of the slot 162, thereby permitting partial removal of the sanitary shield 166 and partial opening of the dispensing slot 162.

An appreciation of the other aims and objectives of the present invention and an understanding of it may be achieved by referring to the accompanying drawings and the detailed description of a preferred embodiment.

The invention claimed is:

1. A combination food pad container and dispenser comprising:

a sealed elongated container, said container is sized and shaped to slidably surround a plurality of horizontally stacked food pads, said pads having at least one planar surface;

said container is formed of flexible film material and having at least one surrounding wall, a closed top and a closed bottom;

said at least one surrounding wall comprises a front wall, a rear wall, first and second side walls, all of said walls being attached to said closed top and said closed bottom;

said surrounding wall having a pair of parallel, closely spaced, openable perforations, said perforations being centrally located on said surrounding wall and orthogonal to said planar surface, said perforations providing a dispensing opening in said container;

said perforations beginning above a fifth stacked food pad above said closed bottom and terminating below a fifth stacked food pad below said closed top;

said perforation having at least one arresting feature, said arresting feature providing an intermediate point for controlling initial opening of said perforation;

said arresting feature being a straight cut line through said flexible film material of said container extending orthogonally across both of said perforations at a point disposed between an upper end and a lower end of said perforations; and a single, separate, unattached, planar, rigid member extending for an entire interior height and an entire interior width of said dispenser, said single, separate rigid, planar member being disposed within said dispenser between said rear wall and said food pads in a plane parallel to said rear wall and supporting said dispenser in a free-standing vertical orientation.

2. The combination food pad container and dispenser, as described in claim 1, further comprising at least one mounting aperture, said aperture is disposed adjacent said top.

3. The combination food pad container and dispenser, as described in claim 1, wherein said dispenser further comprises hooking and looping elements for mounting to a surface.

4. The combination food pad container and dispenser, as described in claim 1, wherein said dispenser is mounted to a surface using an element selected from the group comprising:

hooks, posts, mounting spikes, prongs, chords and ties.

5. The combination food pad container and dispenser, as described in claim 2, further comprising a wall mounting bracket, said bracket having attachment features for attaching to a wall and at least one protrusion, said protrusion is sized and shaped to fit slidably within said at least one mounting aperture.

* * * * *